US005822882A

United States Patent [19]

Anger

[11] Patent Number: 5,822,882

[45] Date of Patent: Oct. 20, 1998

[54] FREEZE DRYER METHOD AND APPARATUS WITH ENCLOSED HEATER AND CONTROLLER

[75] Inventor: Alan R. Anger, Champlin, Minn.

[73] Assignee: Freezedry Specialties, Inc., Osseo, Minn.

[21] Appl. No.: 685,342

[22] Filed: Jul. 23, 1996

Related U.S. Application Data

[63] Continuation-in-part of Ser. No. 375,814, Jan. 20, 1995, abandoned.

[51] Int. Cl.[6] ..... F26B 5/06

[52] U.S. Cl. ..... 34/296; 34/297; 34/92

[58] Field of Search ..... 34/289, 290, 296, 34/297, 92

[56] References Cited

U.S. PATENT DOCUMENTS

| | | | |
|---|---|---|---|
| 3,740,860 | 6/1973 | Smith, Jr. | 34/289 |
| 4,033,048 | 7/1977 | Van Ike | 34/289 X |
| 4,090,312 | 5/1978 | Fraser | 34/92 |
| 4,173,078 | 11/1979 | Bird et al. | 34/92 |
| 4,597,188 | 7/1986 | Trappler | 34/92 X |
| 4,780,964 | 11/1988 | Thompson, Sr. | 34/92 X |
| 4,802,286 | 2/1989 | Kobayashi et al. | 34/289 |
| 5,131,168 | 7/1992 | Rilke et al. | 34/92 X |
| 5,269,077 | 12/1993 | Bruttini | 34/92 |
| 5,353,519 | 10/1994 | Kanamaru et al. | 34/92 |

OTHER PUBLICATIONS

Newsletter—Issue Six: "Sanitary Intelligence! Service is our Secret, Listening our Tool!", The sani–tech Group, Andover, NJ, admitted prior art.

*Pharmaceutical Production TechSource*, "Editorial Comment—Packaging Opportunities Through Lyophilization", Timothy Pearcy and Alan Anger, Medical Manufacturing TechSource, Inc., Ann Arbor, MI, Feb. 1990, Issn: 0891–9461, vol. 5, No. 2, p. 3.

Article entitled "Freeze Dry and Vacuum Package", admitted prior art.

Article entitled "Lyophilized immunoassay reagents and blood samples", D.J. Kesler, Feb. 1993.

Freezedry Specialties, Inc. Advertisement entitled "The Ultimate Taxidermy Tool", Freezedry Specialties, Inc., Osseo, MN, admitted prior art.

Freezedry Specialties, Inc., Advertisement entitled "The Ultimate Floral Tool", Freezedry Specialties, Inc., Osseo, MN, admitted prior art.

*Primary Examiner*—Henry A. Bennett
*Assistant Examiner*—Steve Gravini
*Attorney, Agent, or Firm*—Westman, Champlin & Kelly, P.A.

[57] ABSTRACT

A freeze dryer includes a freezer unit having a plurality of walls defining a freezer interior. A housing defining a chamber suitable for receiving a specimen to be freeze dried is mounted to one of the panels to extend through an aperture therein into the freezer interior. A lid engages the housing to seal the housing. A condenser and a pump are coupled to the housing to lower pressure in the chamber and to condense liquid from the specimen.

14 Claims, 14 Drawing Sheets

FREEZE DRYER METHOD AND APPARATUS WITH ENCLOSED HEATER AND CONTROLLER

INCORPORATION BY REFERENCE

The present application is a continuation-in-part of U.S. patent application Ser. No. 08/375,814, filed Jan. 20, 1995 entitled FREEZE DRYER, and is currently abandoned.

BACKGROUND OF THE INVENTION

The present invention is drawn to freeze drying technology. More particularly, the present invention is drawn to an improved freeze dryer.

Preservation methods have long been the subject of human study. In fact, since the beginning of recorded history, man has struggled to find methods of preservation suitable to the long term storage of goods and other objects. The many methods developed include mummification which was essentially perfected by the Egyptians, freeze drying (also referred to as lyophilization) which was initially developed by the Ancient Indians of the High Andes Mountains. In addition, modern man has developed a variety of preservation techniques including chemical preservation, mechanical refrigeration, cryogenic preservation and dehydration.

Conventional freeze dryers require a vessel which is suitable for holding a specimen to be freeze dried under low pressure (or vacuum) conditions. The freeze dryer also includes a condenser surface which maintains a condensing surface temperature cold enough to create, and collect, vapor which the specimen yields throughout the sublimation process. Finally, conventional freeze dryers require a vacuum pumping system which has enough capacity to reduce the pressure in the vessel (or chamber) quickly, and to maintain low pressure (or high vacuum) conditions throughout the freeze drying cycle.

Prior freeze dryers have typically been very large metal freeze dryers which cost a great deal to run, and which had very long drying times. Significant advantages over such large metal systems were obtained by two freeze drying systems introduced by Applicant a number of years ago. The freeze drying systems were commercially referred to as the Sani-Dry™ Freeze Dryer and the Taxi-Dry™ Freeze Dryer. Both freeze drying units include a translucent freeze drying chamber which is connected to a remote condenser which is, in turn, connected to a vacuum pump. The remote condenser is typically filled with dry ice which maintains a condensing surface in the condenser at a temperature cold enough to condense and collect vapor yielded by the specimen to be freeze dried during the sublimation process. The vacuum pump is suitable for creating a vacuum within the freeze drying chamber. In addition, the translucent chamber allows energy to be injected into the system simply by utilizing a radiant light source.

However, all of the methods currently used suffer from disadvantages. The disadvantages associated with conventional freeze drying systems include the cost of freeze drying equipment, and the associated operating expenses, as well as excessive drying times with conventional large metal equipment. In addition, conventional freeze dryers include a freeze drying chamber which is fixed in one position. Therefore, the freeze drying chamber is unsuitable for accommodating some specimens requiring a particular orientation. Also, conventional freeze dryers incur difficulty in maintaining the specimen to be freeze dried in a solidly frozen state. Further, the operating expenses of conventional freeze dryers typically are quite high because the material used in cooling the condenser surface is commonly quite expensive. In addition, there is no practical means of controlling the amount of energy supplied to conventional systems in an efficient manner. Therefore, conventional freeze dryers suffer from widely varying controllability.

SUMMARY OF THE INVENTION

A freeze dryer includes a freezer unit having a plurality of walls defining a freezer interior. A housing defining a chamber suitable for receiving a specimen to be freeze dried is mounted to one of the panels to extend through an aperture therein into the freezer interior. A lid engages the housing to seal the housing. A condenser and a pump are coupled to the housing to lower pressure in the chamber and to condense liquid from the specimen.

In one preferred embodiment, a thermally insulated covering layer is disposed over a heater. The heater is located proximate the housing within the freezer unit. A thermally insulated covering layer, in the preferred embodiment, comprises a thermal blanket wrapped about a heating blanket.

DETAILED DESCRIPTION OF THE PREFERRED EMBODIMENTS

Figure 1:
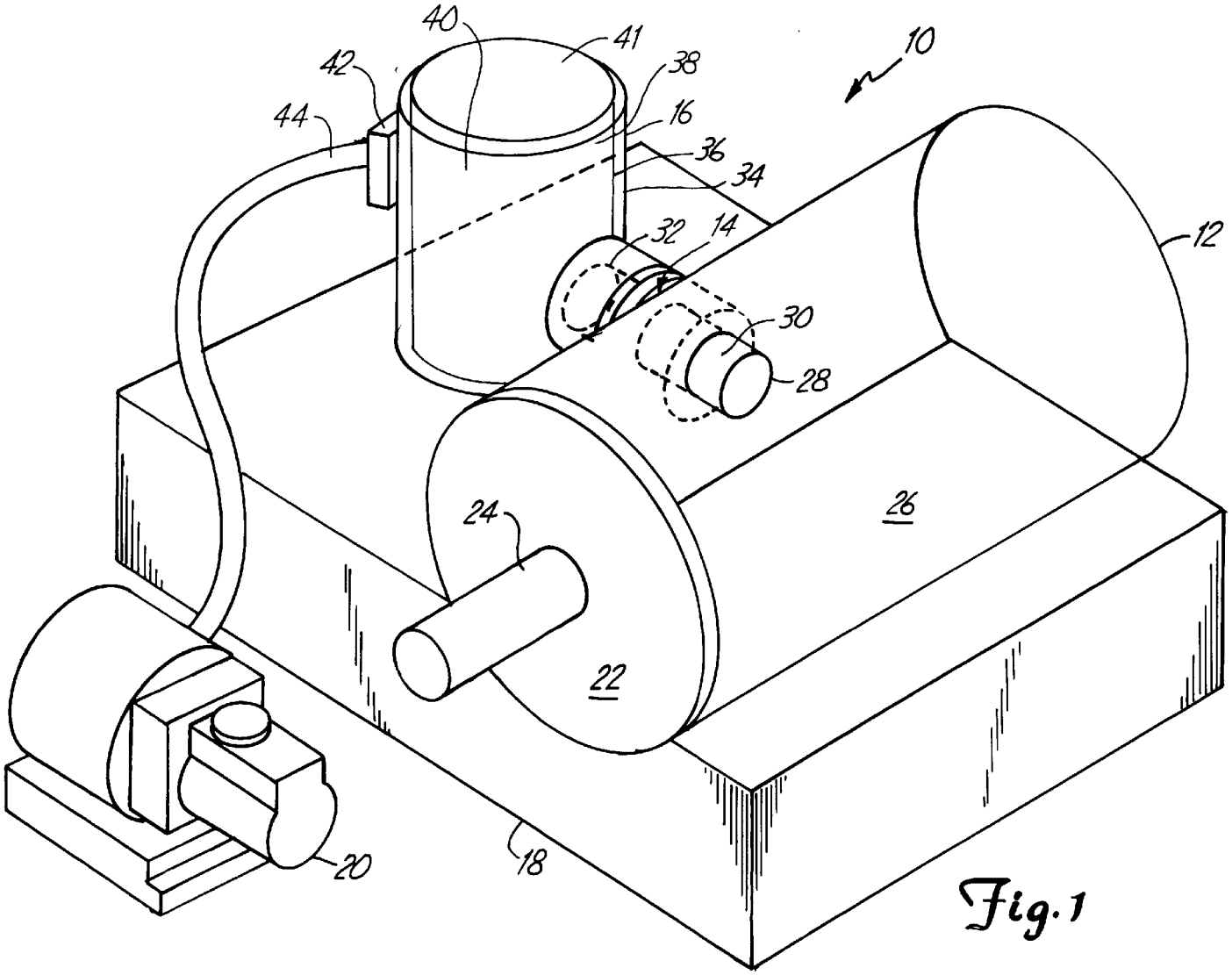
FIG. 1 is a drawing of a freeze dryer according to the present invention.

FIG. 1 illustrates a freeze dryer 10 according to the present invention. Freeze dryer 10 includes freeze drying chamber 12, vapor transfer port 14, condenser 16, base 18, and vacuum pump 20. Freeze drying chamber 12 is a translucent (preferably glass) chamber which has an access opening covered by cover 22. In the preferred embodiment, cover 22 is fitted with handle 24. Chamber 12 also includes, disposed therein, specimen support member 26. Specimen support member 26 assists in maintaining a specimen to be freeze dried in a solid, frozen state. This will be described in greater detail with respect to FIG. 5.

Chamber 12 has an aperture 28 which communicates with a coupling conduit 30. Coupling conduit 30 is coupled, by vapor transfer port 14, to condenser inlet conduit 32. Vapor transfer port 14 is described in greater detail with respect to FIGS. 2 and 2A–2G. Suffice it to say that conduits 30 and 32 are coupled in a sealed, communicating relation relative to one another.

Condenser 16 is preferably formed of a two-ply glass container. The two-plies of glass define an outer surface 34 and an inner surface 36. Surfaces 34 and 36 define a condensing chamber 38 therebetween. Inner surface 36 also defines a container 40 with an upper access opening 41. Container 40 is suitable for receiving a coolant such as dry ice. The coolant significantly cools inner surface 36 so that inner surface 36 becomes the condensing surface for freeze dryer 10.

A coupling member 42 is coupled to a conduit 44 and to outer surface 34. Coupling member 42 provides communication between the interior of conduit 44, at one end of conduit 44, and condensing chamber 38. Conduit 44 is coupled, at its other end, to vacuum pump 20.

In operation, the specimen to be freeze dried is frozen and placed on specimen support member 26 in freeze drying chamber 12. Cover 22 is then placed on chamber 12. Coolant is placed in container 40 such that condensing surface 36 is cooled to a temperature below that of the frozen specimen in freeze drying chamber 12. Pump 20 is then activated and draws a vacuum in both condensing chamber 38 and freeze drying chamber 12. The pressure created by pump 20 is below one atmosphere, and even more preferably, the pressure in chamber 12 in a range of approximately 50–100 milliTorr. Under such conditions, essentially all of the liquid matters which are frozen into a solid state in the frozen specimen vaporize and migrate to the cold point in the system which is condensing surface 36. At condensing surface 36, the materials condense and again solidify. During this sublimation process, the frozen specimen is substantially dried.

In the preferred embodiment, condensing surface 36 is cooled to approximately −55° to −110° F. If only water is to be dried from the specimen of interest, then condensing surface 36 need be cooled only to a temperature of approximately −50° to −60° F. However, where such substances as fats, oils, and other such materials are to undergo sublimation, the temperature of condensing surface 36 must be much colder.

Freeze drying chamber 12 is preferably translucent because such a characteristic allows needed energy to be transferred into the freeze drying system 10 from ambient light conditions. It has been found that approximately 600 calories are required by the system in order to sublime each gram of water once the pressure in chamber 12 is below one atmosphere. Therefore, radiant energy can be utilized to transfer energy into the system in a very efficient manner. Additional energy can be transferred into the system mechanically by providing a variable light source impingent upon chamber 12. This will be described in greater detail with respect to FIG. 8.

Figure 2:
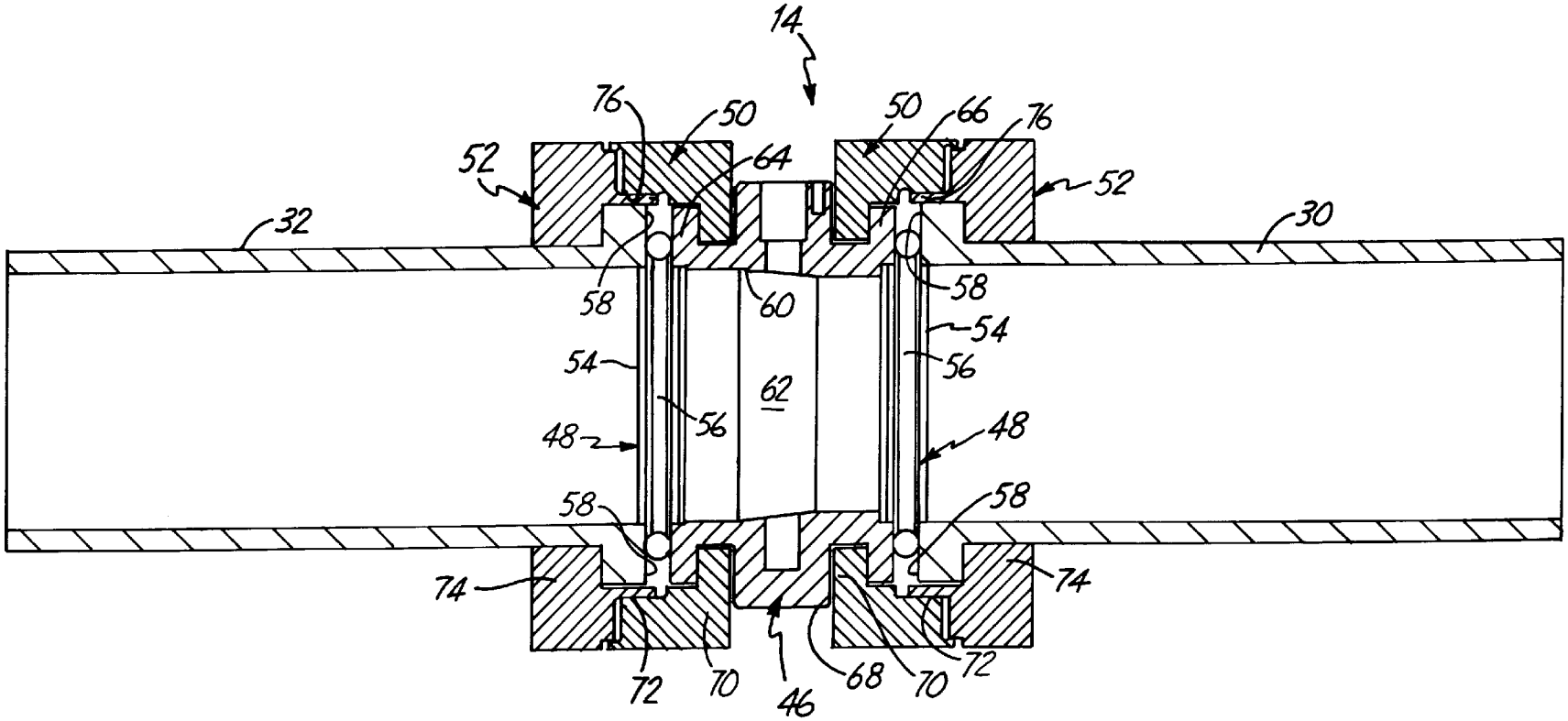
FIG. 2 is a side view of a vapor transfer port according to the present invention, shown in section.

FIG. 2 is a side sectional view of vapor transfer port 14. Transfer port 14 includes valve housing 46, a pair of valve seal rings 48, a pair of valve side clamps 50 and a pair of tube side clamps 52. Valve seal rings 48 have tube ends 54 which are disposed within conduits (or tubes) 30 and 32, respectively. Tube ends 54 are cylindrically shaped and have an outer periphery just smaller than the inner periphery of the corresponding conduits 30 and 32. Valve seal rings 48 support O-rings 56 which extend out beyond the inner periphery of conduits 30 and 32 and rest against extending surfaces 58 of conduits 30 and 32.

Valve housing 46 has a generally cylindrical and tapered interior surface 60 which defines a valve passageway 62. Valve passageway 62 connects the interior of conduit 30 with the interior of conduit 32. Valve housing 46 also has two generally annular flanges 64 and 66 on opposing sides of valve housing 46. Annular flanges 64 and 66 are separated by a central, generally annular protrusion 68. Annular flanges 64 and 66 abut O-rings 56 in generally opposing relation to surfaces 58 of conduits 32 and 30, respectively.

When valve housing 68 is held in the position shown in FIG. 2, a vacuum-tight seal is formed between conduits 30 and 32. Valve housing 46 is held in such a position by clamps 50 and 52. Valve side clamps 50 are identical to one another, but are simply oppositely disposed relative to valve housing 46. Valve side clamps 50 have an inwardly extending flange 70 which abuts outwardly extending flanges 64 and 66 of valve housing 46. Valve side clamps 50 also have a threaded surface 72 which extends outwardly, away from valve housing 46.

Tube side clamps 52 are identical to one another, but are oppositely disposed relative to valve housing 46. Tube side clamps 52 have a ring portion 74 which has an interior periphery just larger than the exterior periphery of conduits 30 and 32. Tube side clamps 52 also have an extending ring portion 76 which has a threaded exterior surface. The threaded exterior surface of ring 76 threadably engages the threaded surface 72 of valve side clamps 50. Tube side clamps 52 are rotatable relative to valve side clamps 50. Thus, tube side clamps 52 can be rotated so that the threaded surfaces draw tube side clamps 52 and valve side clamps 50 toward one another. This causes flanges 64 and 66 of valve housing 46 to abut O-rings 56 which, in turn, abut surfaces 58 of conduits 30 and 32. Thus, the vacuum-tight seal is formed.

Figure 2A:
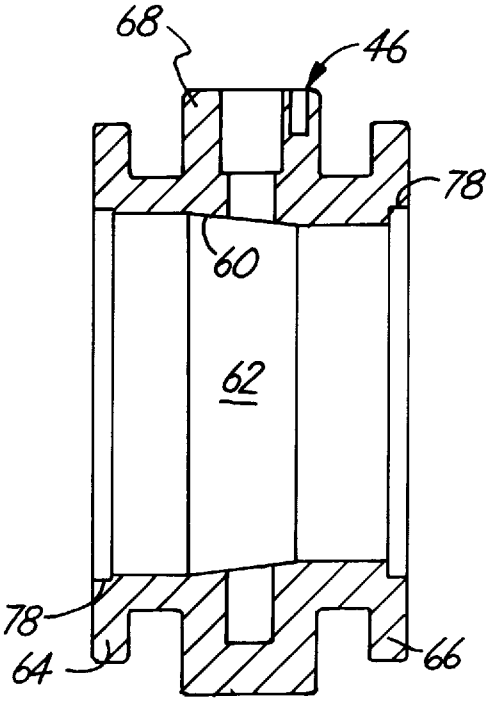
FIG. 2A is a sectional side view of a valve housing which is a portion of the vapor transfer port shown in FIG. 2.

FIG. 2A shows valve housing 46 in greater detail. Similar items are similarly numbered to those shown in FIG. 2. FIG. 2A illustrates that the interior surface of valve housing 46 has a plurality of small notches 78 which receive valve seal rings 48. The notches allow ease of positioning valve seal rings 48 relative to valve housing 46.

Figure 2C:
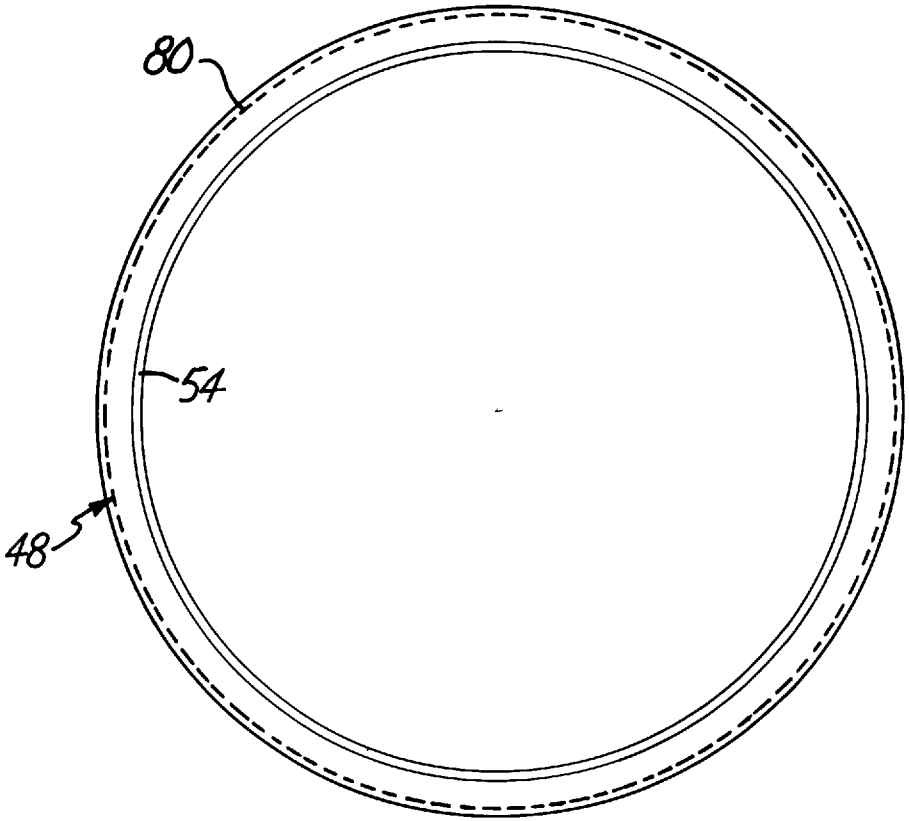
FIGS. 2B and 2C illustrate a valve seal ring which is a portion of the vapor transfer port shown in FIG. 2.
Figure 2B:
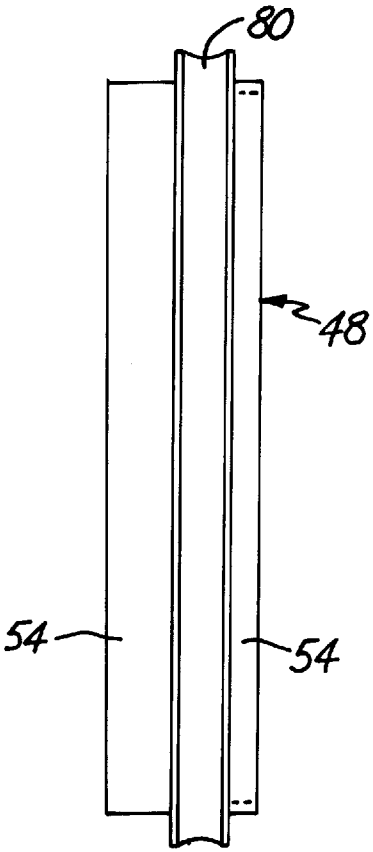

FIGS. 2B and 2C illustrate valve seal rings 48 in greater detail. For the sake of clarity, the O-rings 56 are removed. Similar items are similarly numbered to those shown in FIGS. 2. FIGS. 2B and 2C show that valve seal rings 48 include an annular groove 80 for receiving O-ring 56. This allows for ease of seating O-ring 56 on valve seal ring 48. FIG. 2B also more clearly illustrates that valve seal rings 48 include extending cylindrical portions 54 which are seated within notches 78 in valve housing 46.

Figure 2E:
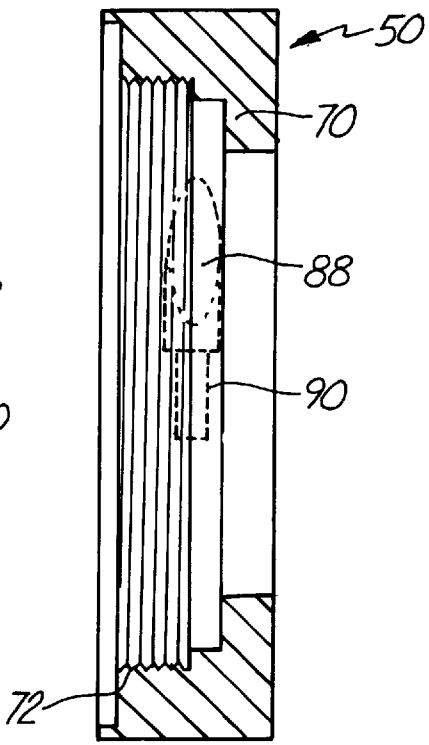
FIGS. 2D and 2E illustrate a valve side clamp which is a portion of the vapor transfer port shown in FIG. 2.
Figure 2D:
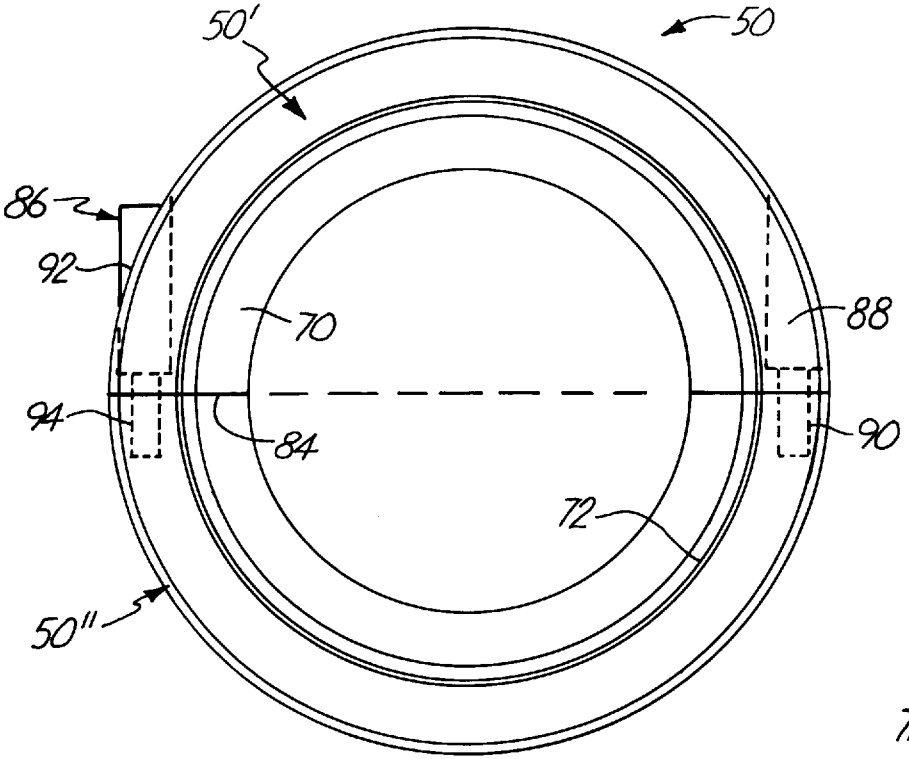

FIGS. 2D and 2E better illustrate valve side clamps 50. Similar items are similarly numbered to those shown in FIG. 2. FIGS. 2D and 2E better illustrate that clamp 50 is a split-ring type clamp which is actually a two piece clamp formed of hemispheric pieces 50' and 50". Pieces 50' and 50" are preferably split along central axis 84. Pieces 50' and 50" are connected together with a pair of screw tabs 86. For the sake of clarity, only one screw tab 86 is shown in FIG. 2D.

Piece 50' is provided with a bore 88 (which is shown in FIG. 2D and in phantom in FIG. 2E). At a first end of bore 88 is a second threaded bore 90 (which is also shown in FIG. 2D and shown in phantom in FIG. 2E). Screw tab 86 has a first portion 92 which is generally cylindrical in shape. At a first end thereof, is a threaded portion 94. In the preferred embodiment, screw tab 86 is integrally formed so that portions 92 and 94 form a single unitary piece. Portion 92 has an outer periphery which is larger than the inner periphery of threaded bore 90. Threaded portion 94 of screw tab 86 has threads on its exterior surface which threadably mate with the threaded interior surface of bore 90. Therefore, as screw tab 86 is inserted into bores 88 and 90, and rotated, the threaded surfaces of screw tab 86 and bore 90 mate with one another to secure portions 50' and 50" together.

Figure 2G:
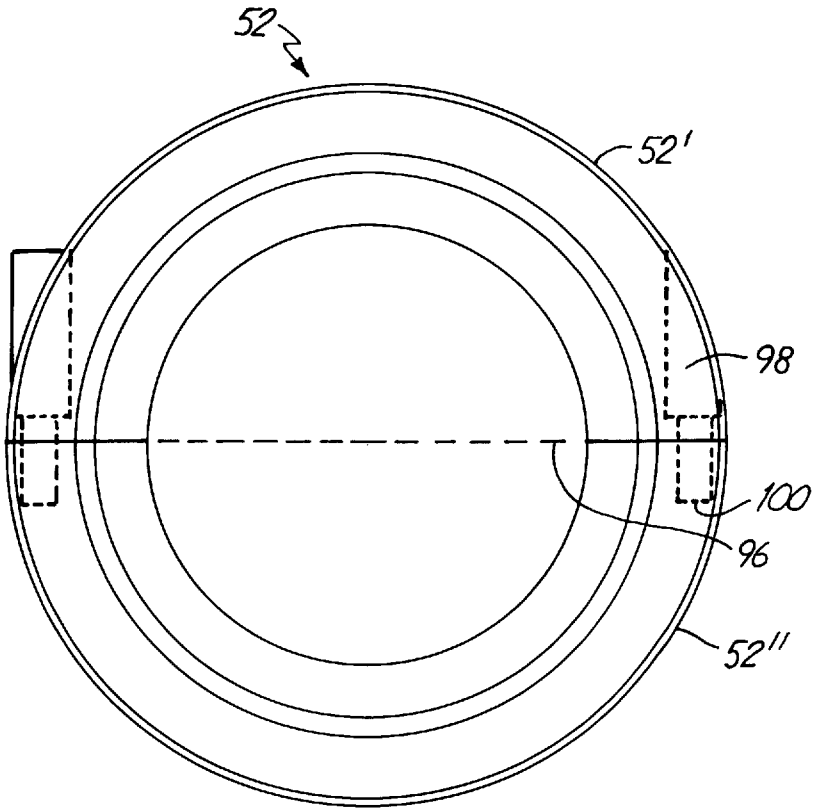
FIGS. 2F and 2G illustrate a tube side clamp which is a portion of the vapor transfer port shown in FIG. 2.
Figure 2F:
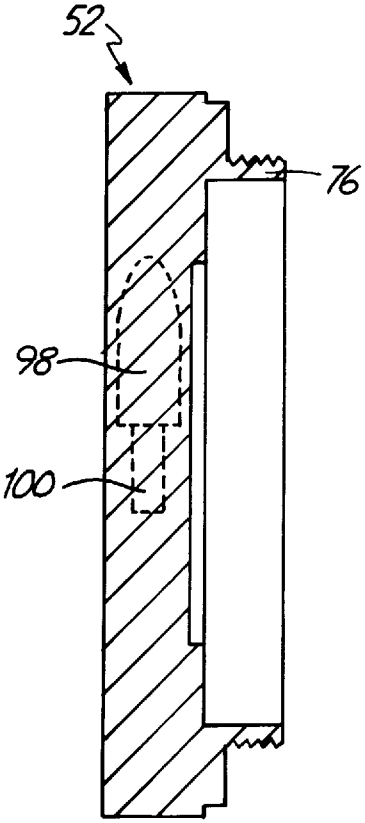

FIGS. 2F and 2G illustrate tube side clamps 52 in greater detail. FIGS. 2F and 2G have similar items similarly numbered to those shown in FIG. 2. FIG. 2G better illustrates that tube side clamp 52 is formed of a two-piece split-ring type clamp formed of two hemispheric pieces 52' and 52". As with clamp 50, clamp 52 is preferably split along a central axis 96. Ring portions 52' and 52" have bores 98 and 100 which are connected together by screw tabs 102. This is done in a similar fashion to that shown with respect to clamp 50.

It will be noted that valve clamp assembly 14 is operable regardless of whether conduits 30 and 32 are rotated relative to one another, so long as they are substantially coaxial as shown in FIG. 2. Therefore, chamber 12 can be rotated 900 relative to the position shown in FIG. 1, and valve clamp assembly 14 is installable and operable just as described with reference to FIGS. 2 and 2A–2G.

Figure 3B:
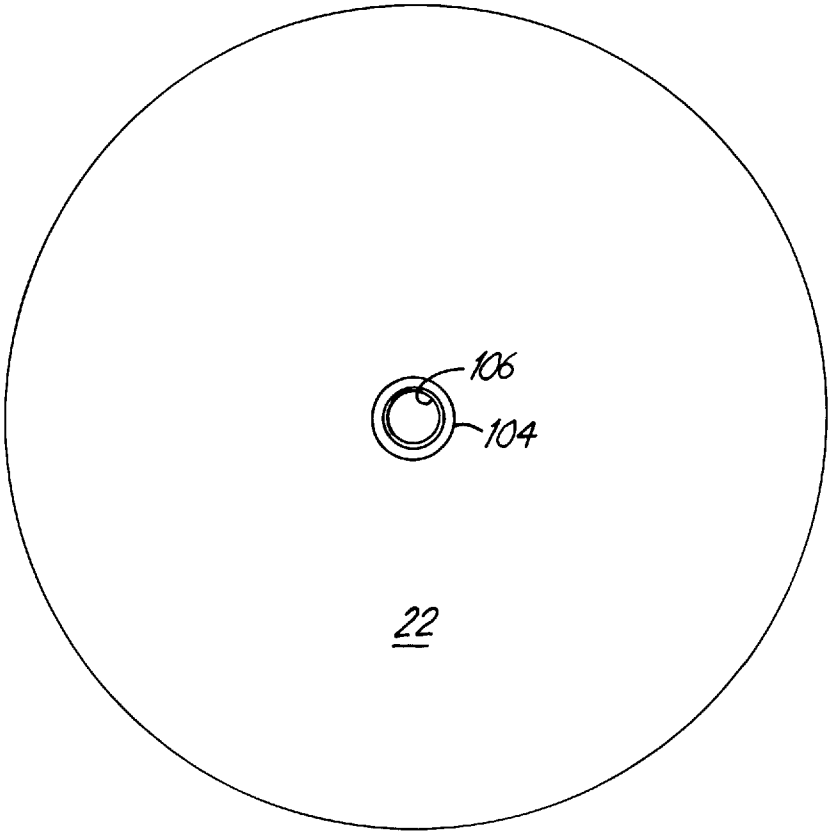
FIGS. 3A and 3B illustrate one embodiment of a cover assembly according to the present invention.
Figure 3A:
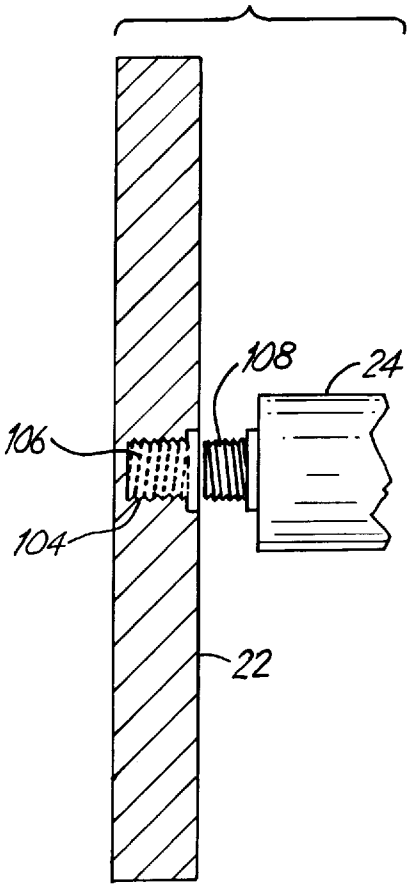

FIGS. 3A and 3B illustrate one preferred embodiment of cover 22 and handle 24. FIGS. 3A and 3B show that cover 22 has a central axial bore 104 which has a threaded interior surface 106. Handle 24 has a lower cylindrical tab 108 with a threaded exterior surface. The threaded exterior surface 108 of handle 24 is sized to threadably engage the threaded surface 106 of bore 104. Therefore, handle 24 can easily be attached to cover 22 by simply screwing tab 108 into bore 104. In addition, once cover 22 is in place on chamber 12 and vacuum pump 20 is actuated, the chamber 12 comes under a vacuum. This draws cover 22 tightly against chamber 12. Therefore, handle 24 can easily be removed by simply unscrewing it from cover 22. This removes what is otherwise an appendage sticking out from cover 22, which can easily by bumped to dislodge cover 22 if freeze dryer 10 is located on a bench or in any other relatively high traffic area.

Figure 4A:
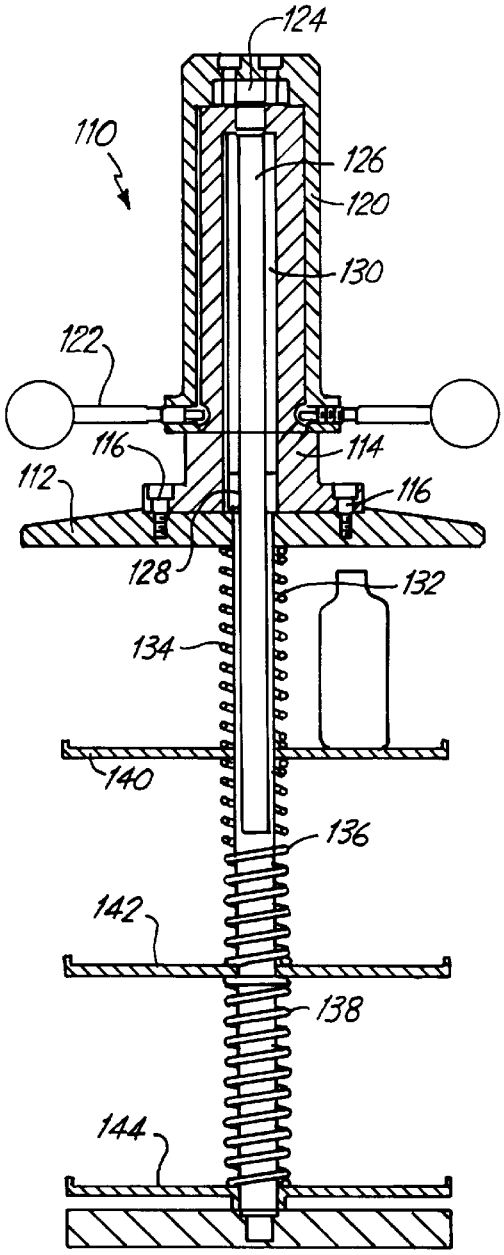
FIGS. 4A and 4B illustrate a second embodiment of a cover assembly according to the present invention.
Figure 4B:
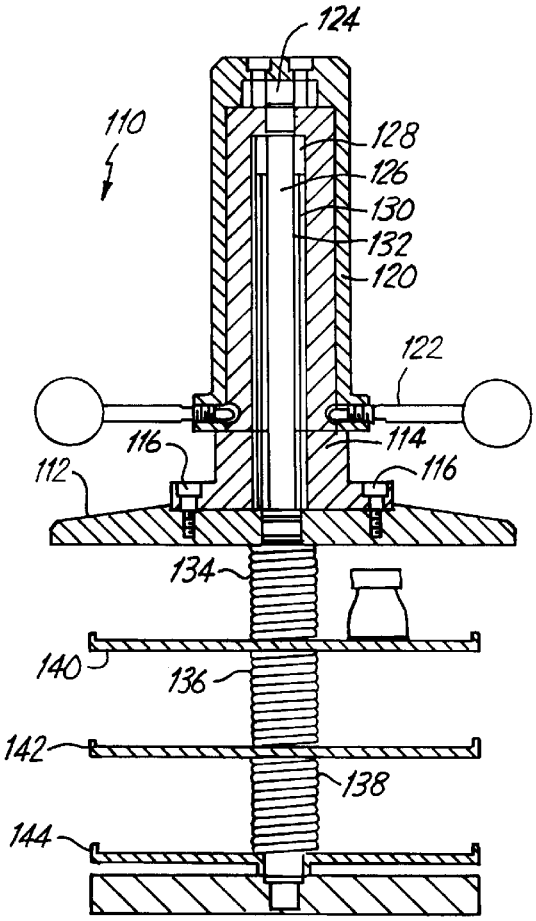

FIGS. 4A and 4B illustrate a second preferred embodiment of a cover according to the present invention. Cover 110 is preferred particularly in instances where pharmaceutical specimens are to be freeze dried in small containers. Where such specimens are to be freeze dried, chamber 12 is preferably rotated 90° relative to that shown in FIG. 1. As will be discussed with respect to FIG. 6, base 18 is formed suitable to accommodate chamber 12 in such a position.

Cover 110 includes a covering member 112 which actually covers the access opening in chamber 12. A support member 114 is rigidly attached to cover portion 112 by a pair of screws 116. The support member 114 supports a rotatable sheath 120 which is rotatably mounted about support member 14. Handles 122 are mounted to, and extend from, rotatable sheath 120. Sheath 120 is rigidly attached by any suitable attachment mechanism 124 to an interior screw 126 which has a threaded exterior surface. Thus, screw 126 is rotatable with sheath 120.

A screw ring 128 has a threaded interior surface and is sized to slidably fit within an inner bore 130 of support member 114. As sheath 120 is rotated, and as screw 126 rotates (in the clockwise direction) screw ring 128 is drawn upwardly along screw 126. Screw ring 128 is attached to an extending cylindrical member 132 which extends below cover portion 112. A plurality of springs 134, 136 and 138 separate a plurality of shelves 140, 142 and 144. The springs have substantially equivalent spring constants and thus exert a substantially similar spring force between plates 140, 142 and 144. As screw ring 128 is drawn up within bore 130, it also draws up extensible portion 132 within bore 130. This effectively results in cover portion 112 exerting a compressive force against spring 134. Since spring 134 abuts shelf 140 which, in turn, abuts spring 136, the downward force exerted by cover portion 112 is substantially spread over springs 134 and 136. Also, since spring 136 abuts shelf 142 which, in turn, abuts spring 138, the downward force exerted by cover portion 112 is essentially split evenly among all three springs 134, 136 and 138. Hence, as downward force is exerted by cover portion 112, all three springs compress equivalently so that the distance between shelves 140, 142 and 144 decreases by a similar amount.

FIG. 4B illustrates cover 110 in a second position, compressed relative to that shown in FIG. 4A. FIG. 4B shows cover 112 screwed all the way downwardly such that springs 134, 136 and 138 are all completely compressed.

Figure 5:
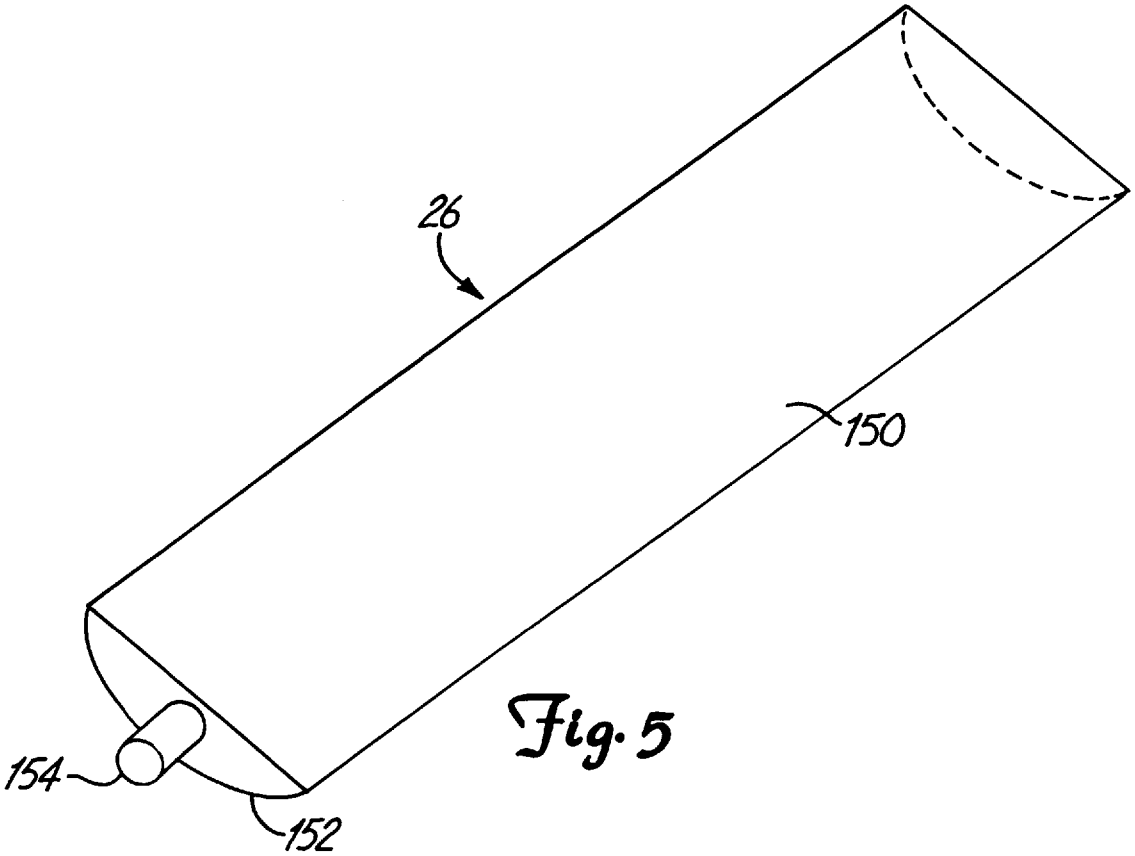
FIG. 5 illustrates a specimen support member according to the present invention.

FIG. 5 shows specimen support member 26 in greater detail. Member 26 has a generally planar top surface 150 and a curved lower surface 152. Lower surface 152 substantially follows the curve of chamber 12 such that, when member 26 is placed within chamber 12, it fits snugly against the interior surface of chamber 12. It should also be noted that member 26 can be rigidly fixed within chamber 12 or integrally formed with chamber 12.

FIG. 5 shows that support member 26 has a valve, or sealable opening 154. In a preferred embodiment, opening 154 is suitable for receiving a coolant. In preferred operation, coolant is injected into the interior portion of support member 26 and frozen. Then, the specimen to be freeze dried is placed on support member 26 during the freeze drying process. This helps keep the specimen to be freeze dried in a solid frozen state. The coolant can be any suitable coolant, and it has been observed that the coolant which is sold under the commercial name Utek™ by Polyfoam Packers Corporation of Wheeling, Ill. works well. However, any other suitable coolant could be used.

Figure 6:
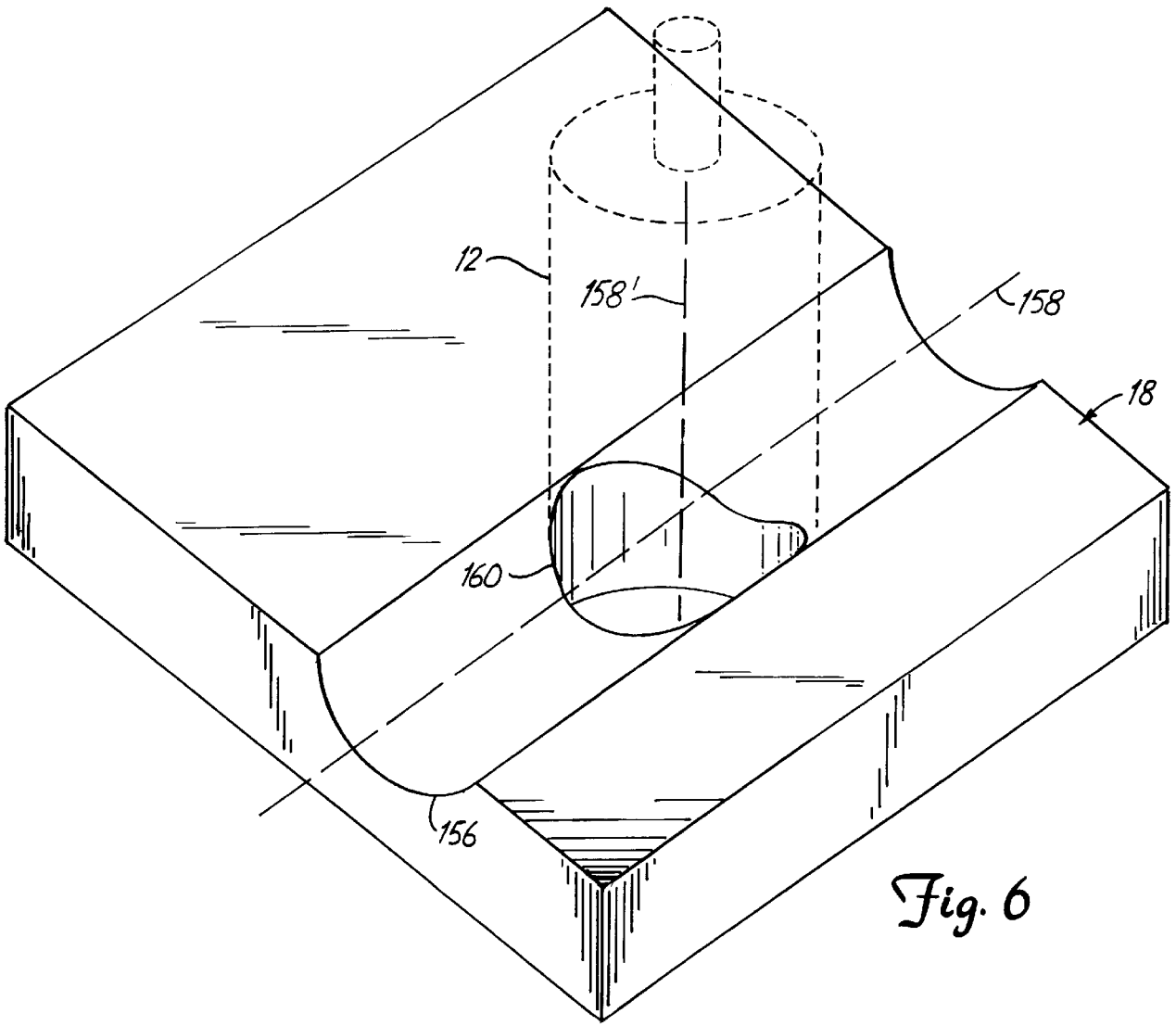
FIG. 6 illustrates a base portion according to the present invention.

FIG. 6 illustrates base 18 in greater detail. In the preferred embodiment, base 18 is formed of a foam or extruded material. Also, base 18 preferably includes a number of depressions or cavities. In order to accommodate chamber 12 as shown in FIG. 1, base 18 has a generally hemispheric depression 156. The curvature of depression 156 is preferably formed to closely conform to the curvature of the exterior surface of chamber 12. Thus, when chamber 12 is in a first position lying on base 18 with its longitudinal axis (represented by dashed line 158 in FIG. 6) generally in alignment with depression 156 (i.e., when chamber 12 is in the position shown in FIG. 1) base 18 supports chamber 12 so that it cannot be easily displaced from its position.

However, base 18 also preferably includes a generally circular aperture or cavity 160. Thus, when chamber 12 is rotated to a second position such that its longitudinal axis (represented by dashed line 158') is at right angles to that when in the first position, then cavity 160 is positioned to support chamber 12 in that position. Chamber 12 is shown in the second position in phantom in FIG. 6. In the preferred embodiment, cavity 160 has an interior dimension which is just larger than the exterior dimension of chamber 12. Thus, cavity 160 closely conforms to the contour of chamber 12.

Figure 7:
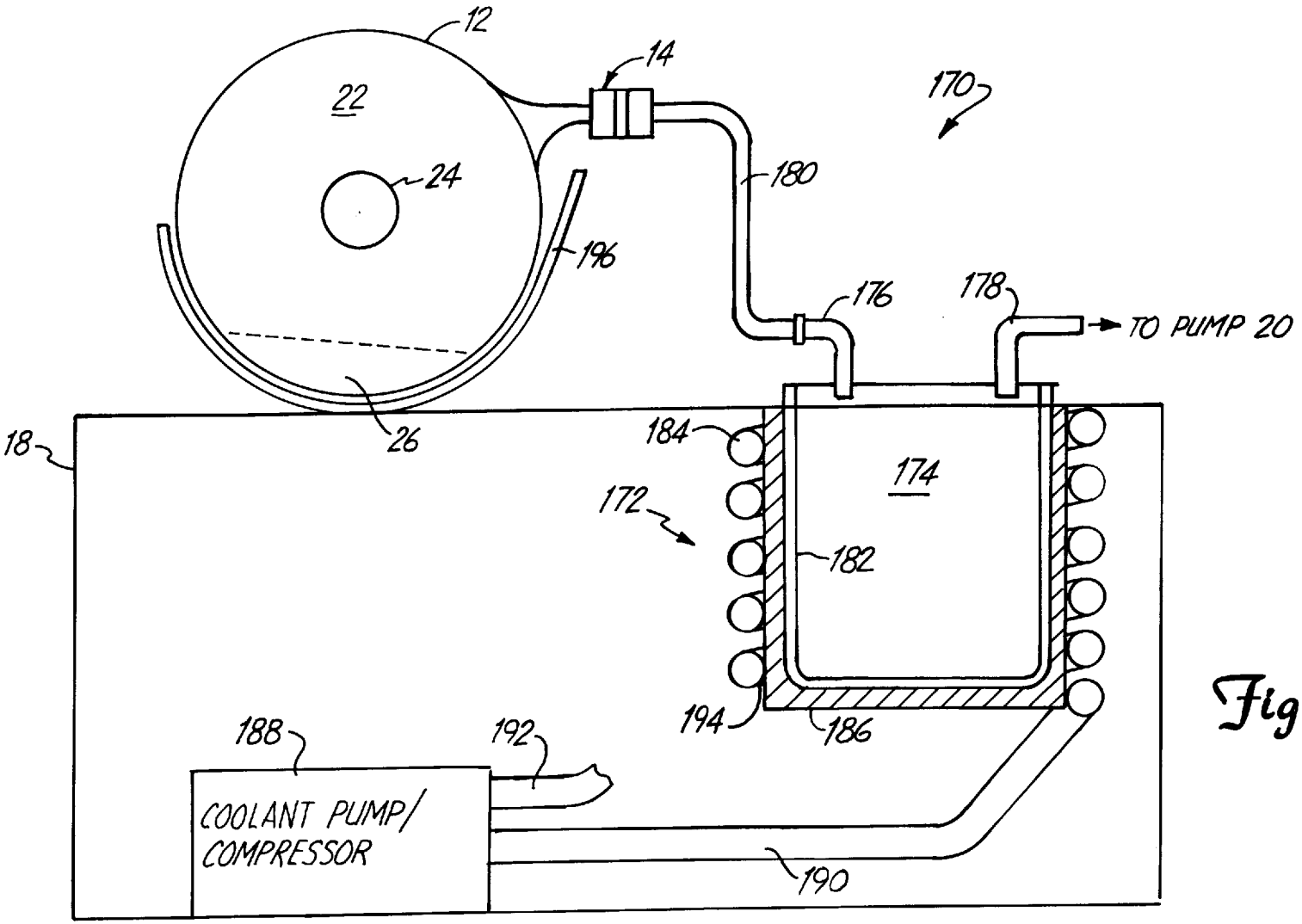
FIG. 7 illustrates a second embodiment of a freeze dryer according to the present invention.

FIG. 7 shows a second embodiment of a freeze dryer 170 according to the present invention. A number of the features are similar to those shown in FIG. 1, and are correspondingly numbered. Freeze dryer 170 operates substantially in the same fashion as freeze dryer 10. However, rather than having condenser 16 which has a condensing surface cooled by dry ice, the embodiment shown in FIG. 7 is provided with vapor trap assembly 172. Vapor trap assembly 172 includes a condensing container 174 which is provided with a pair of couplings 176 and 178, in its cover. Coupling 176 is connected to conduit 180 which is also connected to vapor transfer port 14. Coupling 178 is connected to conduit 44 which is, in turn, coupled to pump 20. Condensing container 174 has an interior surface 182 which serves as the condensing surface. Rather than being cooled by dry ice, surface 182 is mechanically cooled by a cooling coil 184 which is disposed within base 18, and wraps around a condenser cavity 186 formed in base 18. Cooling coil 184 is connected to a cooling pump/compressor and a coolant reservoir 188. Coolant is pumped from the reservoir by pump 188 through an output conduit 190, through coil 184 which coils about cavity 186, and returns through a return conduit 192.

In the preferred embodiment, condenser cavity 186 in base 18 holds a transfer medium (preferably a liquid) 194. Transfer medium 194 is provided to improve the thermal transfer characteristics between coil 184 and condenser surface 182. In the preferred embodiment, transfer medium 194 can be any suitable transfer medium, and it has been observed that a transfer medium under the commercial designation Cryocool™ sold by a company known as Savant Refrigeration of New Jersey works adequately. In addition, the coolant pumped through coil 184 can be any commercially available, suitable coolant, but is preferably a chloroflourocarbon (CFC) free coolant.

Also, in the preferred embodiment, base 18 is provided with chamber cradle 196. Chamber cradle 196 has an interior curvature which substantially follows the exterior curvature of chamber 12 and therefore holds chamber 12 in position.

Figure 8:
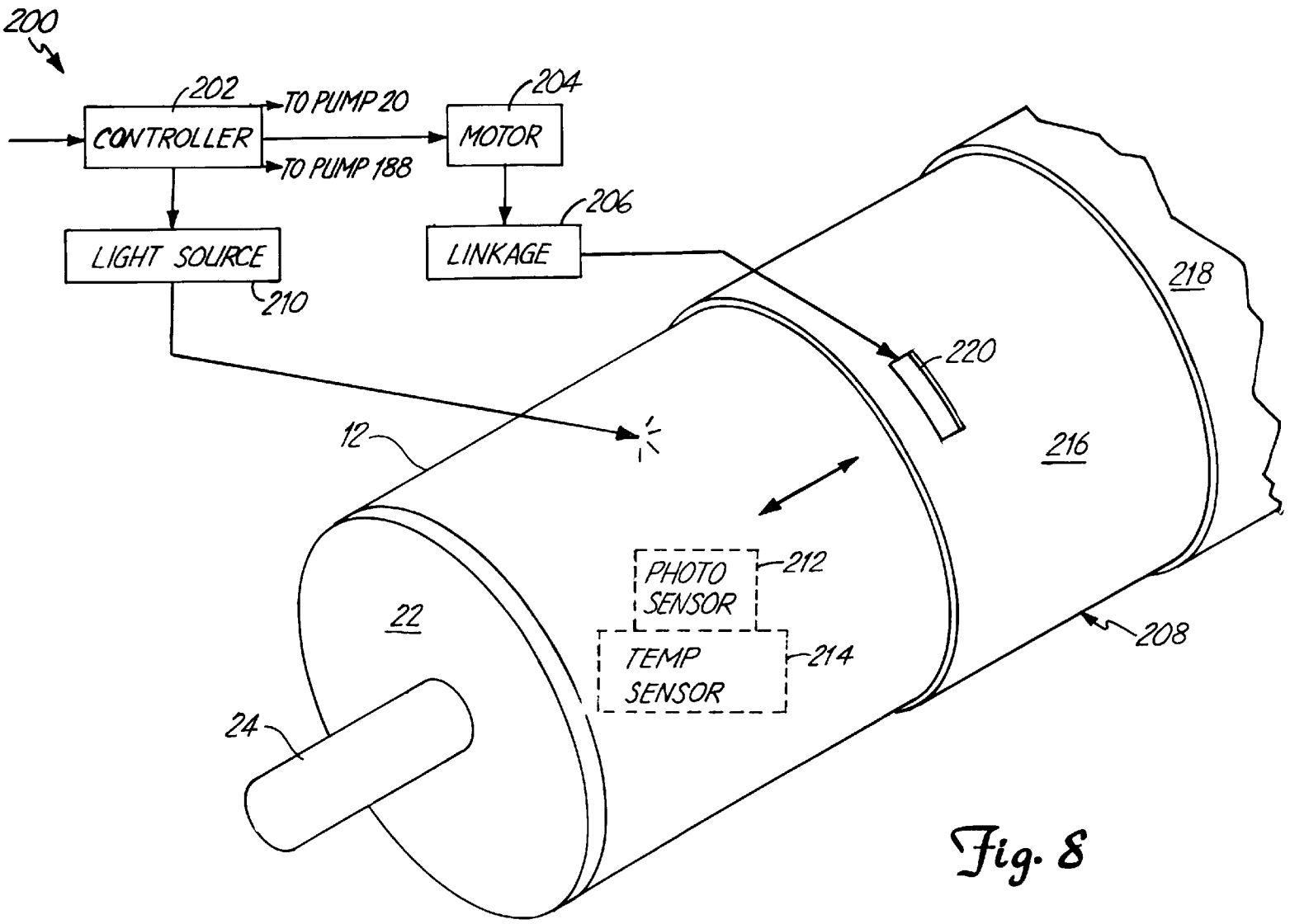
FIG. 8 illustrates, in partial block diagram form, a control mechanism according to the present invention.

FIG. 8 shows a freeze drying system illustrating additional features according to the present invention. FIG. 8 is shown in partial block diagram form. Freeze drying system 200 includes chamber 12 and cover 22. However, system 200 also includes, in the preferred embodiment, controller 202, motor 204, linkage 206, shutter 208, light source 210, photo sensor 212 and temperature sensor 214.

It is generally understood that it takes approximately 600 calories of energy to sublime each gram of water at a pressure below one atmosphere. This energy can be provided in the form of radiant energy from either ambient light conditions, or from a light source. It is critical in freeze drying some components, such as certain chemicals or eutectics, that the energy be provided to the system at a controlled rate which will avoid collapse of the freeze dried specimen matrix. In other words, the specimen must be maintained frozen solid throughout the sublimation process. Thus, the present invention provides chamber 12 as a translucent material, and light (or radiant energy) can therefore be provided to the system. In order to better control this provision of energy, the present invention provides a shutter 208 which is substantially an opaque material formed into a generally cylindrical (or other suitably shaped) shutter which covers chamber 12 and blocks it from receiving additional radiant energy.

In the preferred embodiment, shutter 208 includes a slidable member 216 which slides within guide 218. Shutter 208 can be provided with a handle 220 so that it can be manually moved to a desired position to allow suitable energy input.

In addition, shutter 208 can be coupled, by a suitable linkage such as a chain, gear, ball screw, or other suitable linkage 206, to a motor 204. Motor 204, is preferably a suitable stepper or servo motor which has a control input that can be controlled by controller 202. Controller 202 is preferably a digital computer, programmable logic controller, or other suitable controller which can be programmed to carry out desired operations. Controller 202 preferably has a motor control output which is provided to motor 204 to control rotation of motor 204. This, in turn, controls the movement and position of shutter 208 such that the energy input to the system is controlled.

In the preferred embodiment, controller 202 is also coupled to photosensor 212 and temperature sensor 214. Photosensor 212 is positioned to sense the intensity of radiation impinging on the specimen in chamber 12. Temperature sensor 214 is preferably a thermocouple or infrared thermometer which is coupled to sense the temperature of the specimen to be freeze dried. Both of the sensors provide output signals to controller 202 indicative of the parameter sensed. Based on the output from photosensor 212, controller 202 controls shutter 208. Also, in one preferred embodiment, a variable light source 210 is provided and controlled by controller 202. Therefore, controller 202 controls variable light source 210 to provide additional or less radiant energy to chamber 12.

Temperature sensor 214 provides controller 202 with a signal indicative of the temperature of the specimen to be freeze dried. By monitoring variations in the temperature of the specimen to be freeze dried, controller 202 can determine, using known techniques, the level of moisture remaining in the specimen. Thus, controller 202 controls pump 20 and coolant pump 188 appropriately. In addition, controller 202 preferably uses the signal provided by temperature sensor 214 to also control the position of shutter 208 and light source 210.

Figure 9:
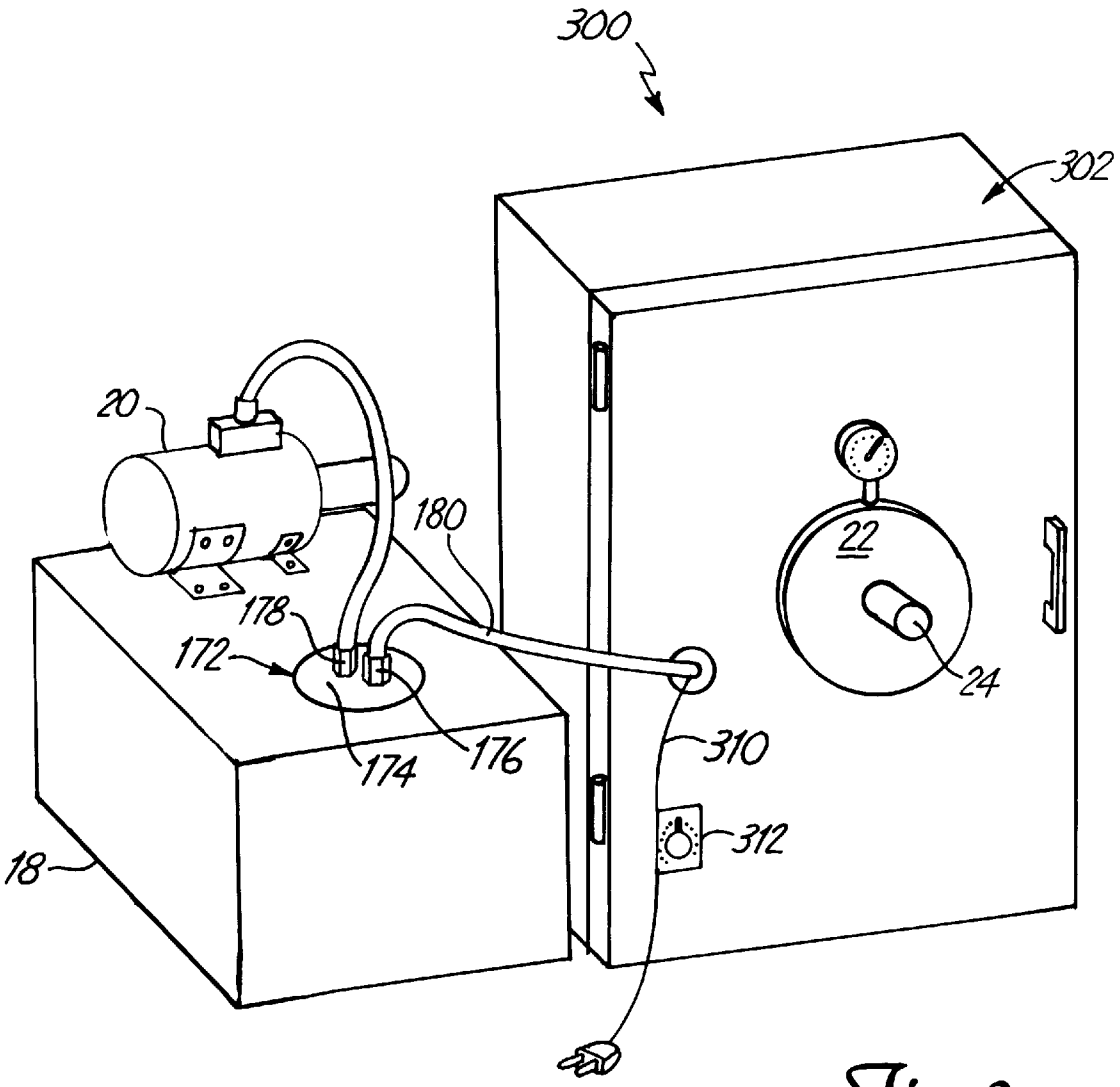
FIG. 9 illustrates another embodiment of a freeze dryer according to the present invention.

FIG. 9 illustrates another preferred embodiment of a freeze dryer 300 according to the present invention. Freeze dryer 300 is similar to the freeze dryer shown in FIG. 7 and similar features are correspondingly numbered. However, freeze dryer 300 also includes a freezer unit 302. Freezer unit 302 is a conventional freezer which is commercially available and has a number of panels defining an interior, as well as a hinged door 304.

The entire freeze drying chamber 12 is preferably disposed within freezer unit 302. A hole or aperture is cut into the door 304 of the freezer unit 302 and a suitable sealing material, such as epoxy or a rubber apron-type seal is placed around the chamber 12. In the preferred embodiment, only the opening portion of the chamber extends out of the freezer interior through the door. Lid 22 is then placeable on the chamber 12 to seal the chamber 12 when vacuum pump 20 is activated to pull a vacuum in the chamber. Freezer unit 302 greatly assists in keeping the specimen to be freeze dried frozen until the primary freeze drying operation is complete.

Figure 10B:
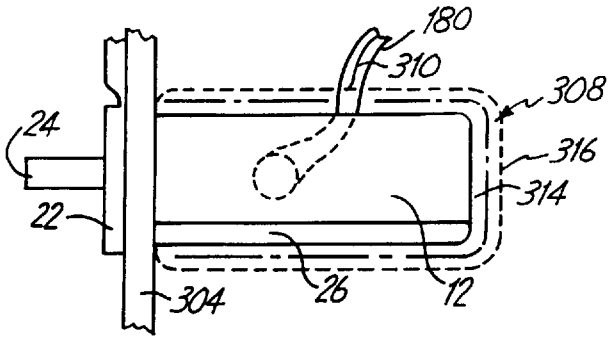
FIGS. 10A–10C show further details of the freeze dryer shown in FIG. 9.
Figure 10C:
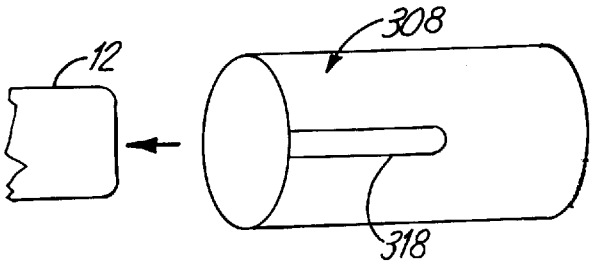
Figure 10A:
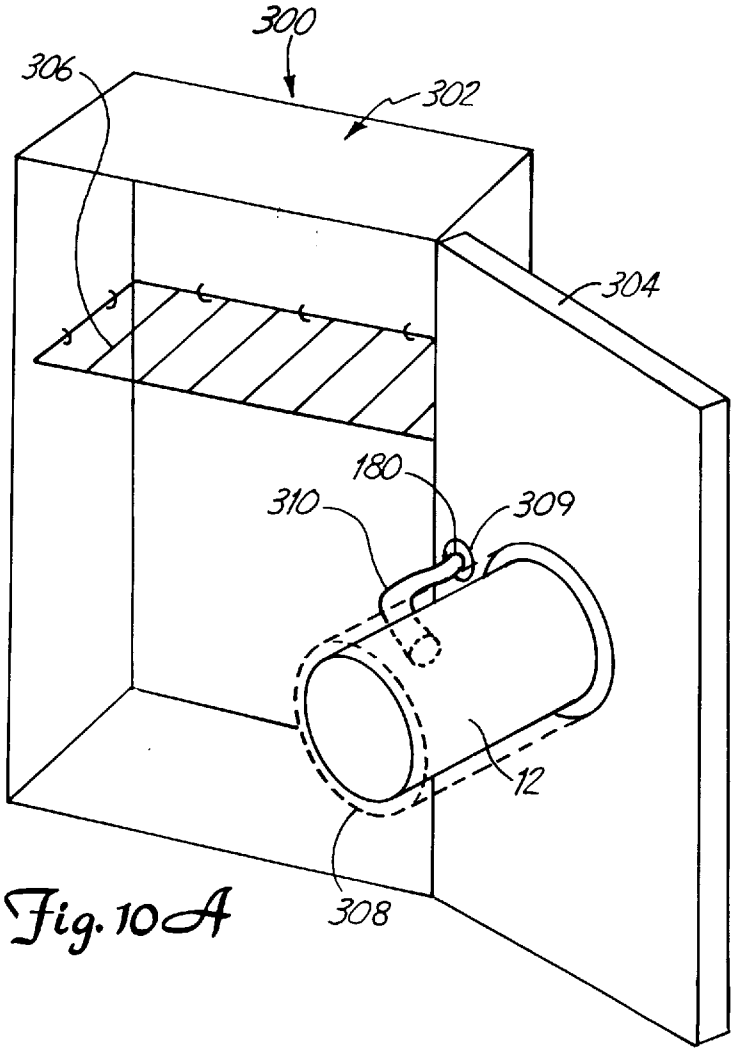

FIGS. 10A–10C illustrate freeze dryer 300, and portions thereof, in greater detail. In FIG. 10A, freeze dryer 300 is shown with hinged door 304 in an open position. It can be seen that, in the preferred embodiment, chamber 12 is essentially entirely disposed within the interior of freezer unit 302 when the door 304 of freezer unit 302 is closed.

Also, in the preferred embodiment, freezer unit 302 is provided with a conventional storage shelf 306 for storing additional specimens to be freeze dried.

FIG. 10A also shows, in phantom, a controllable heating device 308 which is placed around chamber 12. In the preferred embodiment, the controllable heating device is a heating blanket or heating pad which is a conventional electrically actuated heater device, and which is surrounded by a thermally insulating blanket. The thermally insulative blanket is preferably reflective aluminum foil insulation such as that commercially available under the trade name Reflectix198 , Inc. of Markleville, Ind.

Heater unit 308 is provided with an electrical conduit 310 which exits through the door 304 of freezer unit 302. Conduit 310 can also be seen in FIG. 9 and includes a conventional control assembly 312 for controlling the temperature of the heating blanket in heater 308.

Heater unit 308 is provided to assist in adding energy to the freeze drying unit at the end of the freeze drying process. In other words, heater unit 308 is turned off during the initial freeze drying process (or primary freeze drying process) so that the specimen to be freeze dried is kept solidly frozen. During the primary freeze drying process, a vast majority of liquid is transferred from the specimen in chamber 12 to the vapor trap in condensing unit 18. Then, when the vast majority of the fluid has already been dried from the specimen, and during the secondary drying process, freezer unit 302 is turned off (or it can be optionally kept running) and controllable heating unit 308 is turned on using control unit 312. The temperature to which controllable heating unit 308 is controlled varies based on the specimen being freeze dried. However, in the preferred embodiment, the controllable heating unit 308 is first turned on at a very low level and then increased over time during the secondary drying process until the specimen is completely dried.

Freezer unit 302 can either be used in addition to, or in place of, specimen support member 26.

FIG. 10B is a side view of a portion of freeze dryer 300 showing chamber 12 mounted through door 304. FIG. 10B shows that substantially the entire chamber 12 is preferably mounted within freezer unit 300 when door 304 is closed. FIG. 10B also shows, in more detail, controllable heater unit 308. As shown in FIG. 10B, controllable heater unit 308 preferably includes a heating blanket 314 which is disposed wrapped around chamber 12 closely proximate to, or adjacent, chamber 12. Around heating blanket 14, a thermally insulative blanket 316 is wrapped. This allows heater unit 308 to heat up chamber 12, but drastically slows the radiation or conduction of heat from heater unit 308 into the interior of freezer unit 302. This provides for a more efficient system.

FIG. 10C illustrates the assembly operation of heater 308 onto chamber 12. In the preferred embodiment, the layers of heater unit 308 are provided with a slot or other suitable aperture 318 for receiving connection conduits 180 and conductor 310. Therefore, heater unit 308 can simply be slid onto chamber 12 from the rear forward at a desirable time during the freeze drying process. Of course, conductor 310 must be threaded through the aperture 309 in door 304 of freezer 300 at the appropriate time as well.

Figure 11:
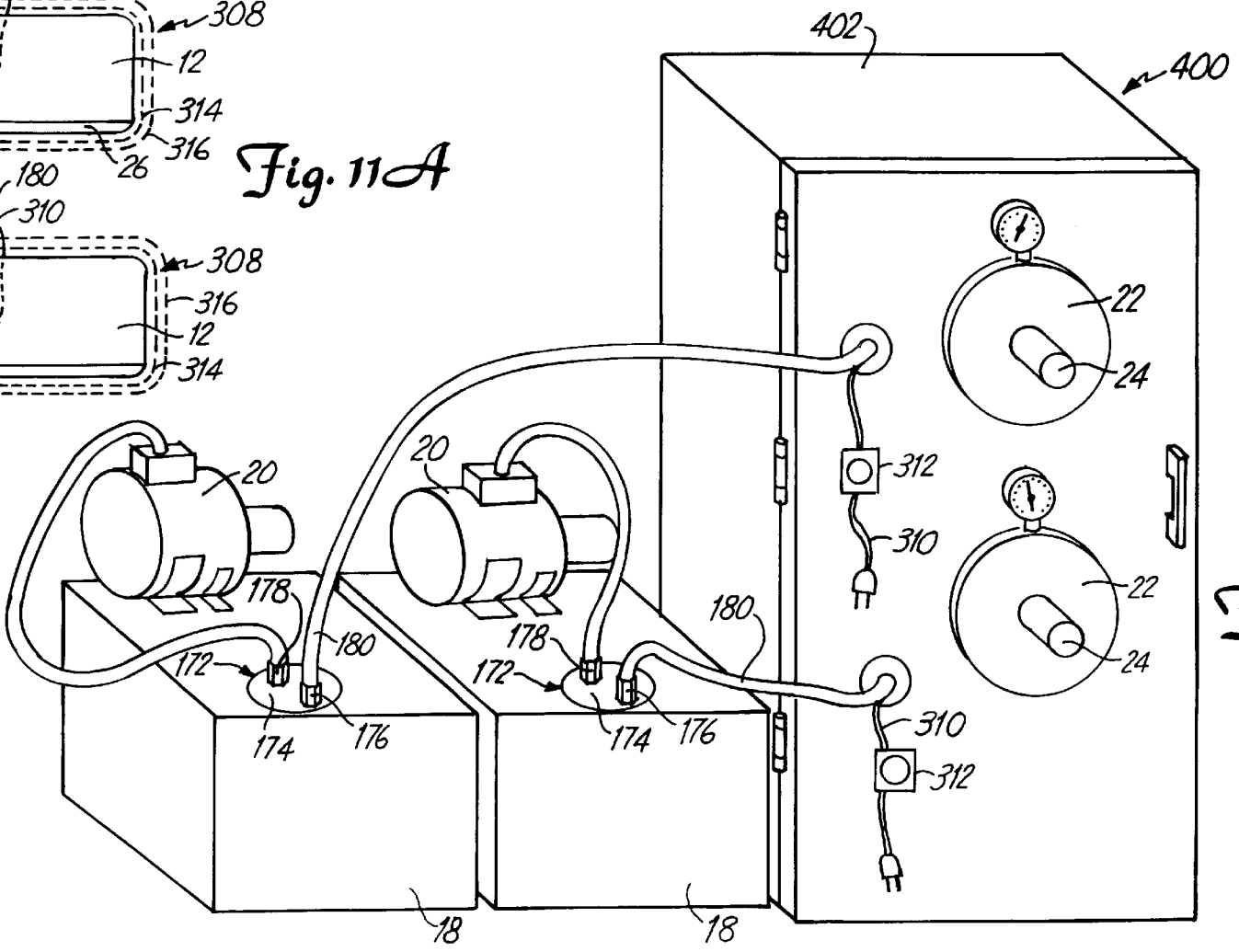
FIGS. 11 and 11A show yet another preferred embodiment of a freeze dryer according to the present invention.

FIG. 11 illustrates yet another preferred embodiment of a freeze dryer 400 according to the present invention. Freezer dryer 400 is similar to freeze dryer 300 shown in FIG. 9 and similar features are similarly numbered. However, freeze dryer 400 includes a substantially larger freezer unit 402 and two chambers 12 are mounted in a panel of freezer 402 to extend into the interior thereof. In addition, the two chambers are provided with corresponding pumps 20 and condensing/vapor trap assemblies 172.

Figure 11A:
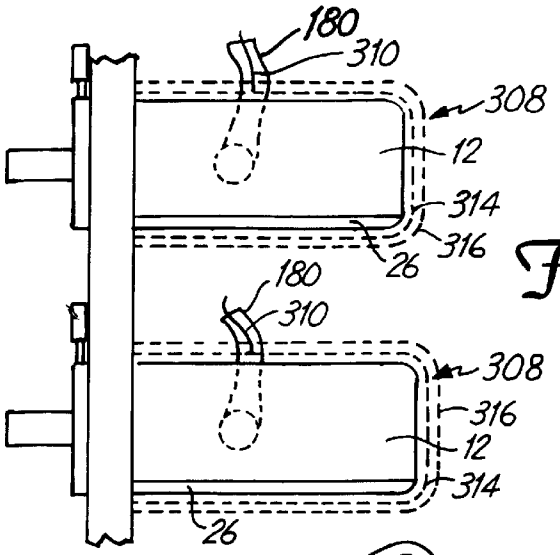

FIG. 11A shows a side view of a portion of freeze dryer 400. Again, this is similar to FIG. 10B and similar features are similarly numbered. However, FIG. 11A shows that, in the preferred embodiment, both chambers 12 are provided with a controllable heating unit 308 as discussed with respect to FIGS. 9 and 10A–10C.

It should, of course, be noted that the chambers in the present invention can be mounted, not only in the door of a freezer unit, but in any panel for a desired operation, such as a side or top panel. However, in the preferred embodiment, the chambers are mounted in the door of the freezer unit.

Thus, the present invention provides a number of significant advantages over prior freeze drying systems. First, the present invention provides a base portion 18 which is suitable for receiving chamber 12 in one of any number of various positions. This provides additional flexibility to the present freeze drying system.

Further, specimen support member 26 is suitable for holding coolant material. This allows the present freeze drying system to maintain the system to be freeze dried in a solid, frozen state better than in prior systems.

Also, in one embodiment of the present invention, base 18 houses a cooling coil which cools the condensing surface in the system. This allows reusable coolant to be used, or at least coolant which is less expensive than previously used dry ice.

It should also be noted that the present invention provides a cover with a removable handle. This reduces bench space required for the freeze dryer and also reduces the probability that the cover will be dislodged accidentally during operation of the freeze dryer.

The present invention also provides a control mechanism for controlling various features of the present freeze drying system. One of the control mechanisms allows control over the amount of radiant energy provided to the translucent chamber 12. The present invention also provides a photosensor and temperature sensor which can be used in controlling the freeze drying process.

Also, the present invention provides an advantageous freezer-mounted chamber to help keep a specimen frozen during the primary freeze drying phase. A thermally insulative heater unit is also provided for adding energy to the system during the secondary drying phase.

Although the present invention has been described with reference to preferred embodiments, workers skilled in the art will recognize that changes may be made in form and detail without departing from the spirit and scope of the invention.

What is claimed is:

1. A freeze dryer, comprising:

a freezer unit having a plurality of walls defining a freezer interior, a first of the plurality of walls having an aperture therein;

a housing defining a chamber suitable for receiving a specimen to be freeze dried, the housing being mounted to the first wall to extend through the aperture within the freezer interior, the housing having an opening therein;

a lid engageable with the housing to seal the opening of the housing;

a condenser remote from the chamber and having an interior coupled for communication with the chamber;

a pump coupled to the chamber to lower pressure in the chamber;

a heater disposed proximate the housing within the freezer unit; and a thermally insulative covering layer disposed over the heater and the housing.

2. The freeze dryer of claim 1 and further comprising:

a second housing defining a second chamber and mounted to extend within the freezer interior, the second housing having an opening therein; and a second lid engageable with the second housing to seal the opening of the second housing.

3. The freeze dryer of claim 2 and further comprising:

a second condenser remote from the second chamber and having an interior coupled for communication with the second chamber; and a second pump coupled to the second chamber to lower pressure in the second chamber.

4. The freeze dryer of claim 2 wherein the second housing is mounted through a second aperture in the first panel to extend within the freezer interior.

5. The freeze drier of claim 1 wherein the first panel comprises a door of the freezer unit movable between an open position and a closed position.

6. The freeze drier of claim 5 wherein the freezer unit further comprises:

a storage shelf mounted within the freezer interior and arranged to avoid the housing when the door is moved between the open position and the closed position.

7. The freeze drier of claim 1 wherein the heater comprises a heating blanket wrapped about the housing and wherein the thermally insulative covering layer comprises a thermal blanket wrapped about the heating blanket.

8. The freeze drier of claim 1 wherein the heater comprises:

a heating device; and a controller coupled to the heating device to control heating of the heating device.

9. The freeze drier of claim 1 wherein the condenser is located outside the freezer interior.

10. A freeze dryer, comprising:

a freezer unit having a plurality of walls defining a freezer interior, a first of the plurality of walls having a first aperture therein and a second aperture therein;

a first housing defining a first chamber suitable for receiving a first specimen to be freeze dried, the first housing being mounted to the first wall to extend through the first aperture within the freezer interior, the first housing having an opening therein;

a first lid engageable with the first housing to seal the opening of the first housing;

a second housing defining a second chamber suitable for receiving a second specimen to be freeze dried and mounted to extend through the second aperture in the first panel within the freezer interior, the second housing having an opening therein; and a second lid engageable with the second housing to seal the opening of the second housing;

condenser means remote from the first and second chambers and having an interior coupled for communication with the first and second chambers, the condenser means for condensing liquids from the first and second specimens;

pump means coupled to the first and second chambers for lowering pressure in the first and second chambers;

wherein the first panel comprises a door of the freezer unit movable between an open position and a closed position;

a selectively controllable heater disposed over the housing; and a thermally insulative covering layer disposed over the heater.

11. The freeze dryer of claim 10 wherein the condenser means comprises:

first and second condenser units remote from the first and second chambers and having an interior coupled for communication with the first and second chambers, respectively.

12. The freeze drier of claim 11 wherein the pump means comprises:

first and second pumps coupled to the first and second chambers, respectively, to lower pressure in the first and second chambers.

13. The freeze drier of claim 10 wherein the freezer unit further comprises:

a storage shelf mounted within the freezer interior and arranged to avoid the housing when the door is moved between the open position and the closed position.

14. A method of freeze drying a specimen, comprising:

providing a freeze drier according to claim 1;

providing a controllable heating unit disposed about the housing;

freeze drying the specimen without activating the controllable heating unit for a first time period;

after the first time period, activating the controllable heating unit to provide heat to the housing;

controlling the controllable heating unit to increase the heat provided to the housing over a second time period; and providing the heating unit as a heating pad covered by a thermally insulative layer and wrapping the heating unit about the housing.

* * * * *